US011439290B2

(12) United States Patent
Shintani et al.

(10) Patent No.: US 11,439,290 B2
(45) Date of Patent: Sep. 13, 2022

(54) CLEANING TOOL

(71) Applicant: DAIO PAPER CORPORATION, Ehime (JP)

(72) Inventors: Naoki Shintani, Ehime (JP); Shinya Izumi, Ehime (JP); Asako Fushimi, Ehime (JP)

(73) Assignee: DAIO PAPER CORPORATION, Ehime (JP)

( * ) Notice: Subject to any disclaimer, the term of this patent is extended or adjusted under 35 U.S.C. 154(b) by 117 days.

(21) Appl. No.: 16/618,859

(22) PCT Filed: May 24, 2018

(86) PCT No.: PCT/JP2018/019935
§ 371 (c)(1),
(2) Date: Dec. 3, 2019

(87) PCT Pub. No.: WO2018/235514
PCT Pub. Date: Dec. 27, 2018

(65) Prior Publication Data

US 2020/0129036 A1 Apr. 30, 2020

(30) Foreign Application Priority Data

Jun. 19, 2017 (JP) ..... JP2017-119946

(51) Int. Cl.
*A47L 13/20* (2006.01)
*A47L 13/254* (2006.01)
(Continued)

(52) U.S. Cl.
CPC ..... *A47L 13/254* (2013.01); *A47L 13/16* (2013.01); *A47L 13/42* (2013.01); *A47L 13/24* (2013.01)

(58) Field of Classification Search
CPC ..... A47L 13/24; A47L 13/254; A47L 13/256; A47L 13/29
(Continued)

(56) References Cited

U.S. PATENT DOCUMENTS 866,897 A * 9/1907 Willey ..... 15/232
1,118,546 A * 11/1914 Goodwin ..... A47L 13/29 15/231
(Continued)

FOREIGN PATENT DOCUMENTS

CN 1377242 A 10/2002
CN 202446017 U 9/2012
(Continued)

OTHER PUBLICATIONS

Partial machine translation of JP 9-224896, Sep. 12, 1997. (Year: 1997).*
(Continued)

*Primary Examiner* — Michael D Jennings
(74) *Attorney, Agent, or Firm* — Maier & Maier, PLLC

(57) ABSTRACT

The present disclosure includes a head part to which a cleaning sheet is attached; and a handle part which is connected to the head part and which is for gripping by a user. The head part includes a top surface part which forms an upper surface side and to which the handle part is connected; and a bottom surface part which forms a lower surface side. The bottom surface part is formed to be freely attachable/detachable with respect to the top surface part. Due to this configuration, it is possible to provide a cleaning tool which can easily clean both low places such as a floor surface and high places such as a ceiling and the upper part of a wall.

14 Claims, 11 Drawing Sheets

(51) Int. Cl.
*A47L 13/16* (2006.01)
*A47L 13/42* (2006.01)
*A47L 13/24* (2006.01)

(58) Field of Classification Search
USPC ..... 15/147.1, 147.2, 228, 231, 232
See application file for complete search history.

(56) References Cited

U.S. PATENT DOCUMENTS

| | | | | | |
|---|---|---|---|---|---|
| 1,139,809 | A * | 5/1915 | Schultz | A47L 13/16 | 15/209.1 |
| 1,469,568 | A * | 10/1923 | Williams | A47L 13/255 | 15/228 |
| 1,526,161 | A * | 2/1925 | Lyon | A47L 13/29 | 15/231 |
| 1,767,766 | A * | 6/1930 | Lunkenheimer | A47L 13/255 | 15/231 |
| 2,205,535 | A * | 6/1940 | Muckenhirn | A47L 13/24 | 15/145 |
| 7,120,962 | B2 * | 10/2006 | Petner | A47L 13/12 | 15/228 |
| 10,045,678 | B2 * | 8/2018 | Hay | A47L 13/44 | |
| 2007/0072460 | A1 * | 3/2007 | Stable | F16B 7/1445 | 439/141 |
| 2008/0098549 | A1 * | 5/2008 | Yang | A47L 13/256 | 15/147.2 |
| 2011/0056035 | A1 * | 3/2011 | Burbacki | A46B 5/0033 | 15/144.1 |

FOREIGN PATENT DOCUMENTS

| | | | |
|---|---|---|---|
| CN | 102753076 | A | 10/2012 |
| DE | 2229603 | * | 5/1985 |
| EP | 782835 | * | 7/1997 |
| GB | 2398231 | * | 8/2004 |
| JP | S6130461 | U | 2/1986 |
| JP | 8-266456 | * | 10/1996 |
| JP | 8-280597 | * | 10/1996 |
| JP | 8-322779 | * | 12/1996 |
| JP | H09140651 | A | 6/1997 |
| JP | 9-224896 | * | 9/1997 |
| JP | 10-43111 | * | 2/1998 |
| JP | 10-52391 | * | 2/1998 |
| JP | 2001173618 | A | 6/2001 |
| JP | 2001-238840 | * | 9/2001 |
| JP | 2001238839 | A | 9/2001 |
| JP | 2001238840 | A | 9/2001 |
| JP | 2003-116765 | * | 4/2003 |
| JP | 2003-135353 | * | 5/2003 |
| JP | 2005245646 | A | 9/2005 |
| JP | 2005-334496 | * | 12/2005 |
| JP | 2006-314363 | A | 11/2006 |
| JP | 2007-54337 | * | 3/2007 |
| JP | 2011183153 | A | 9/2011 |
| JP | 2012-147958 | * | 8/2012 |
| JP | 2013-34766 | A | 2/2013 |
| JP | 2013-74962 | * | 4/2013 |
| JP | 2015181901 | A | 10/2015 |
| WO | 2011/099561 | A1 | 8/2011 |

OTHER PUBLICATIONS

Partial machine translation of JP 2012-147958, Aug. 9, 2012. (Year: 2012).*
Translation of International Search Report dated Jul. 24, 2018 and Written Opinion of corresponding application No. PCT/JP2018/019935; 8 pgs.
Chinese Office Action dated Dec. 3, 2020 of corresponding application No. 201880036818.5; 12 pgs.
Supplementary European Search Report and European Search Opinion dated May 12, 2020 of corresponding application No. EP18821280; 7 pgs.
Japanese Office Action dated Dec. 11, 2018 of corresponding application No. 2017119946; 10 pgs.
Japanese Office Action dated Apr. 16, 2019 of corresponding application No. 2017119946; 10 pgs.
Japanese Office Action dated Sep. 24, 2019 of corresponding application No. 2017119946; 10 pgs.
Decision to Grant a Patent dated Dec. 10, 2019 of corresponding application No. 2017119946; 5 pgs.
Chinese Office Action dated Jul. 7, 2021 of corresponding application No. 201880036818.5; 8 pgs.

* cited by examiner

[FIG. 1]
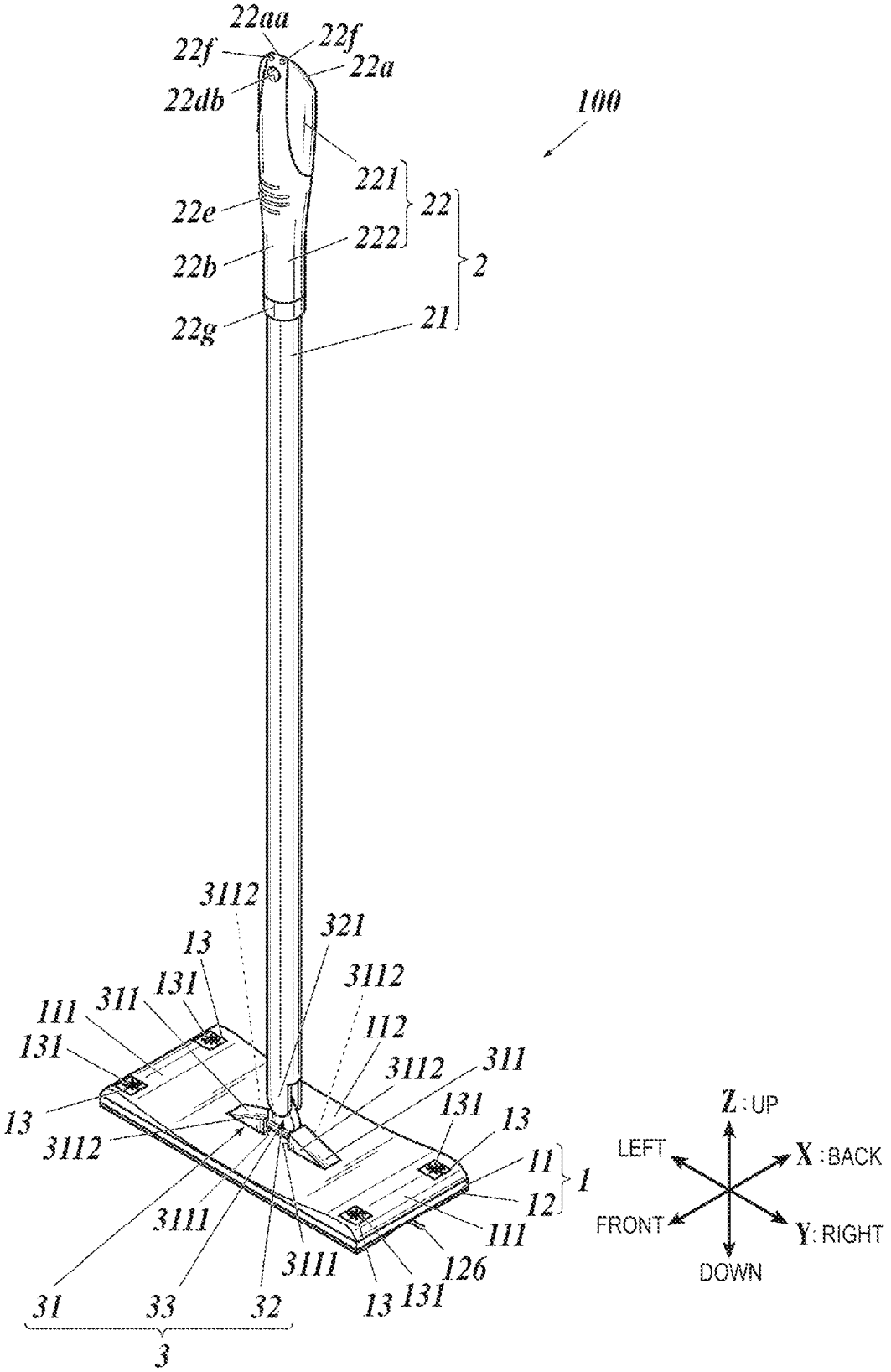

[FIG. 2]
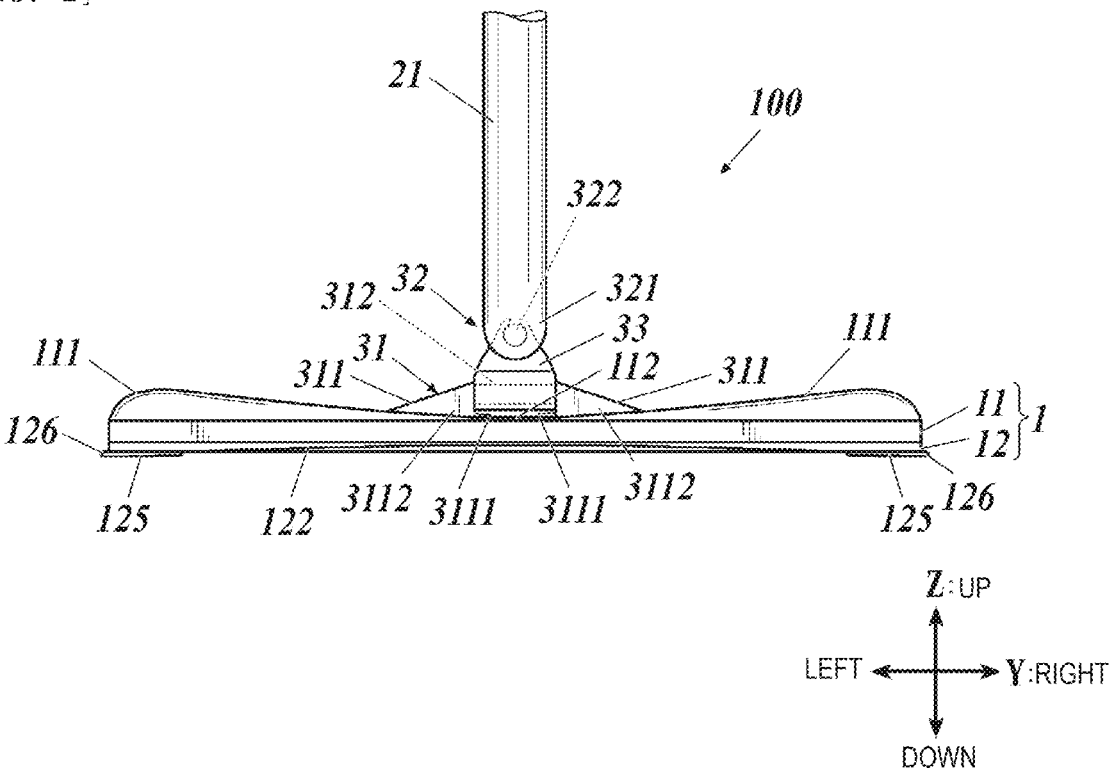
[FIG. 3]
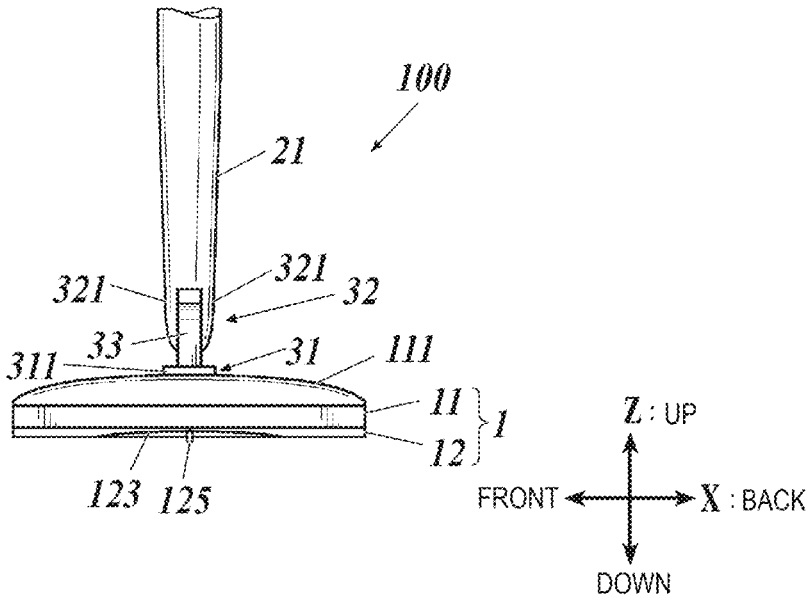

[FIG. 4A]
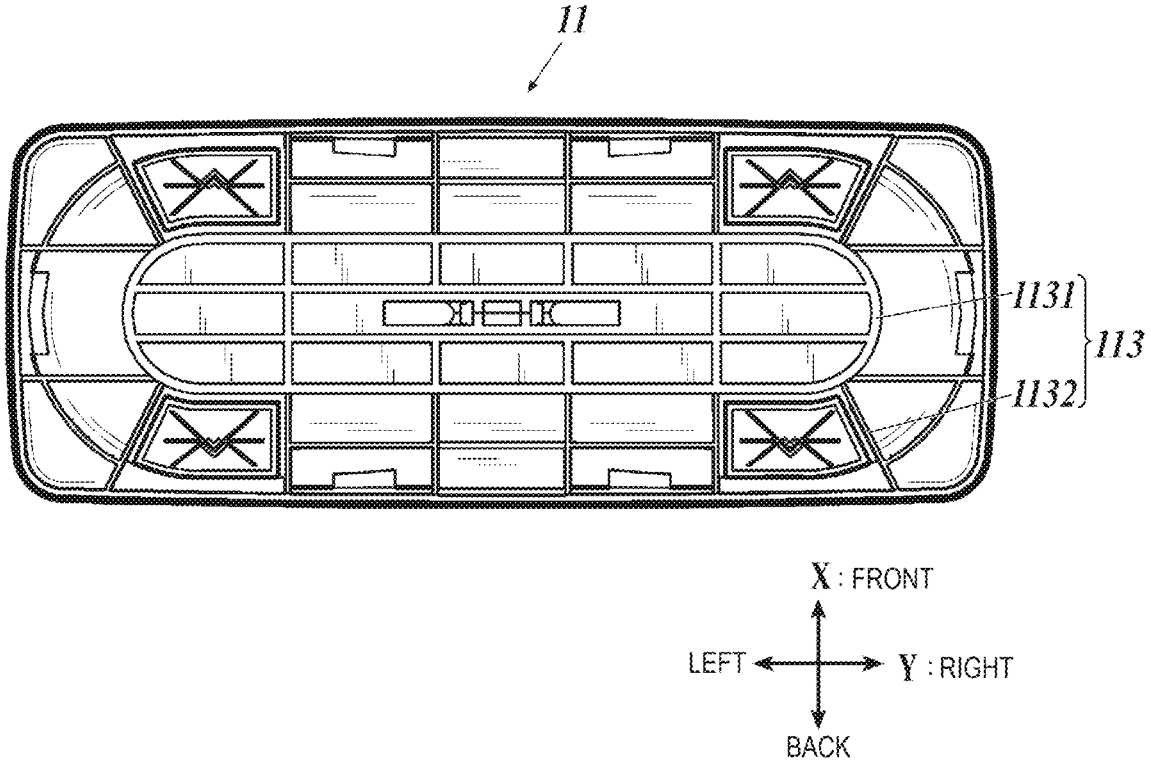
[FIG. 4B]
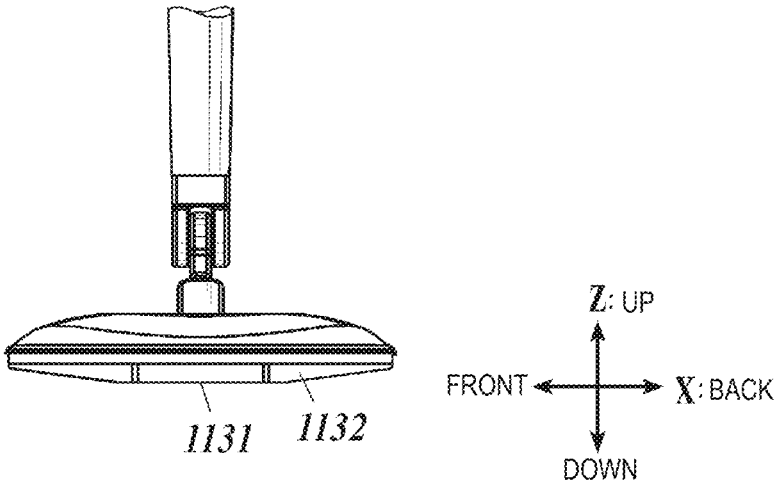

[FIG. 5]
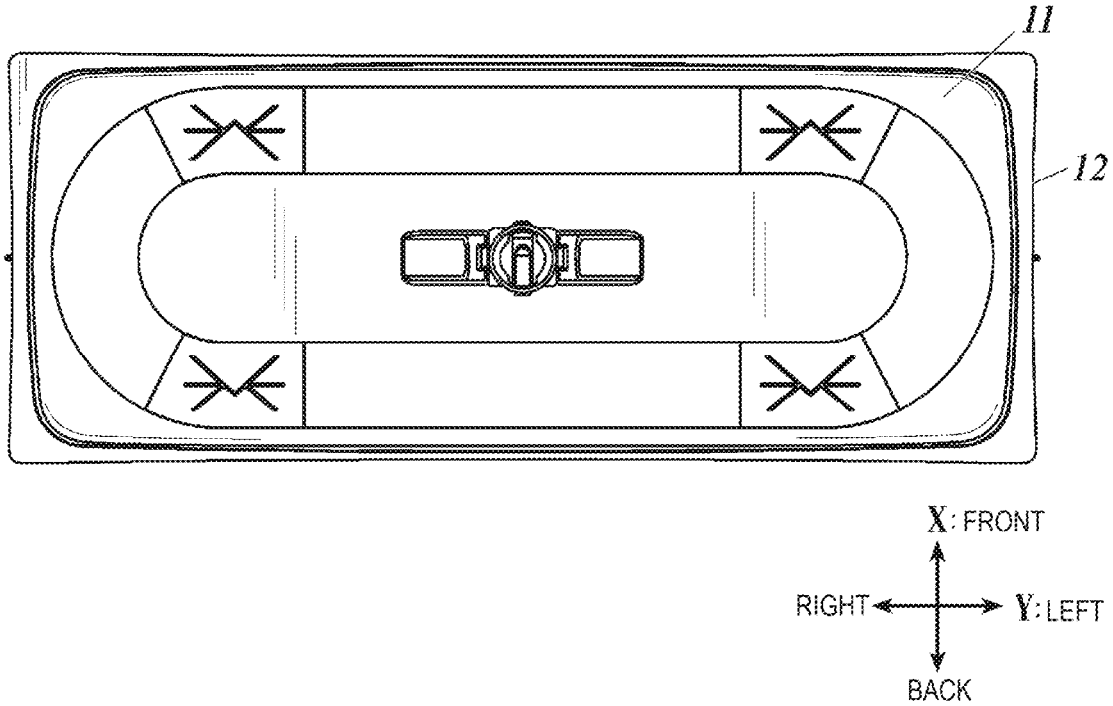
[FIG. 6]
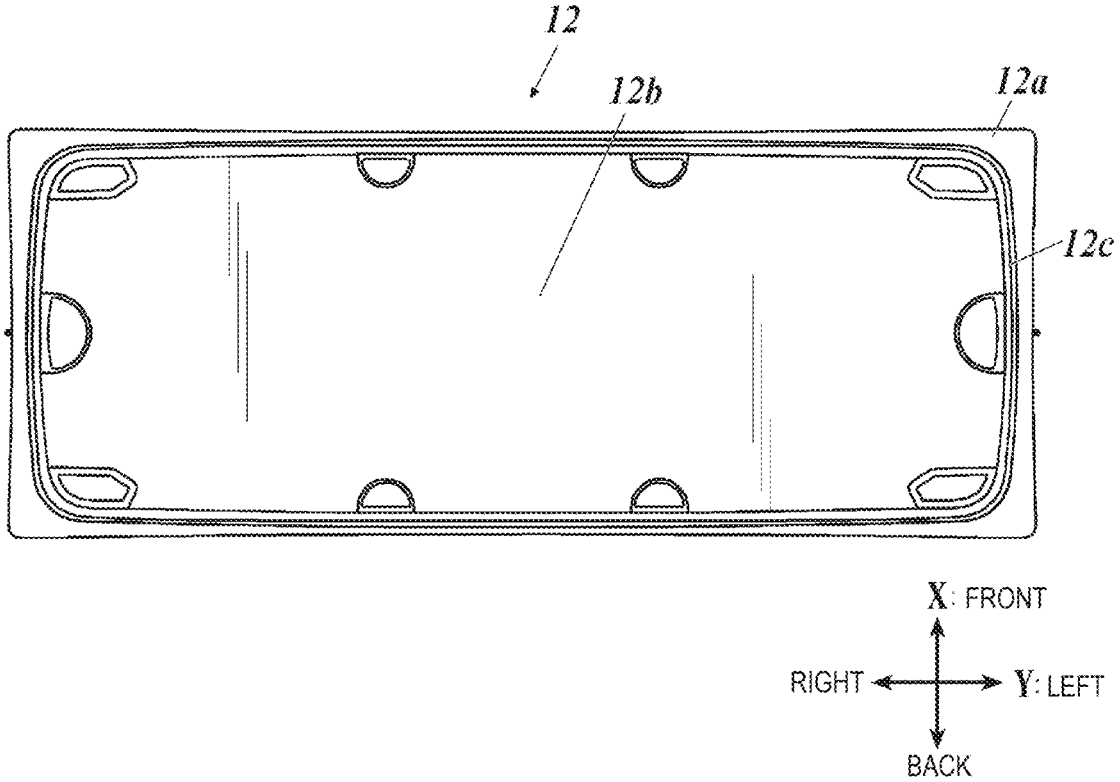

[FIG. 7]
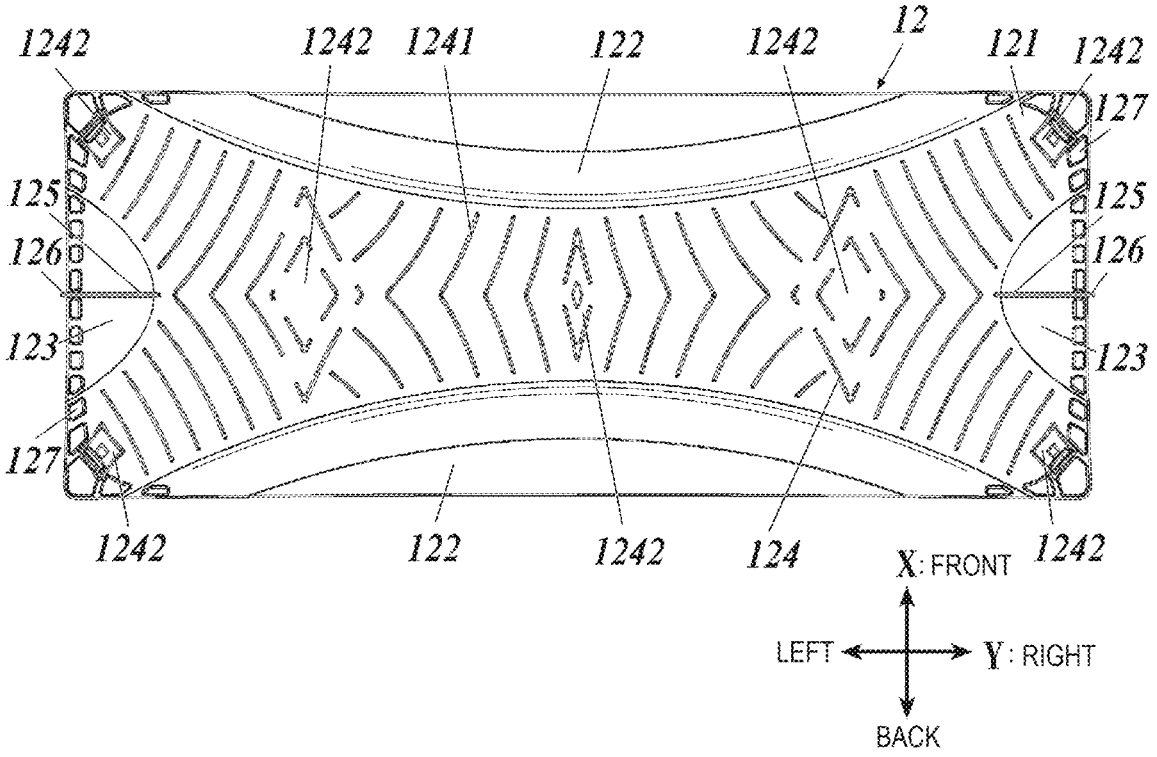

[FIG. 8A]
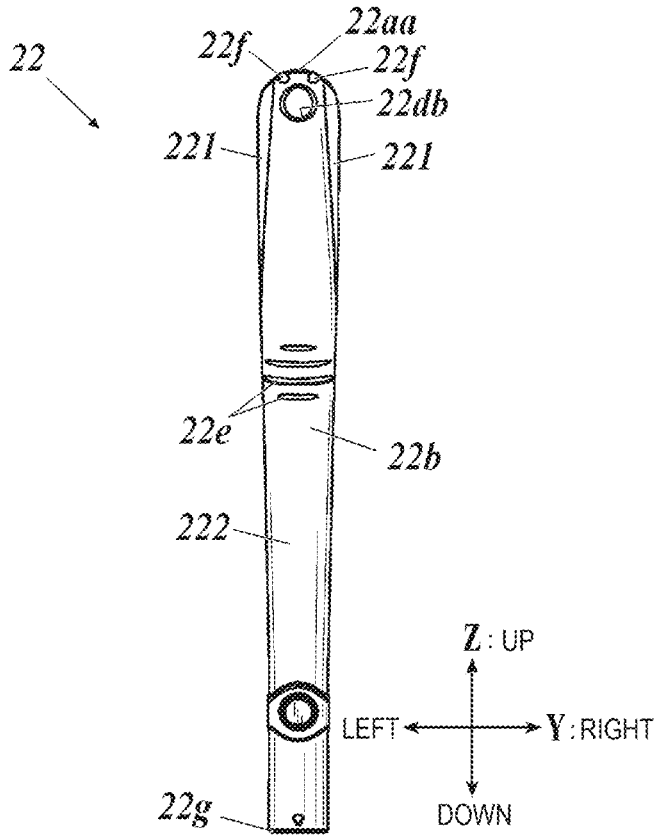
[FIG. 8B]
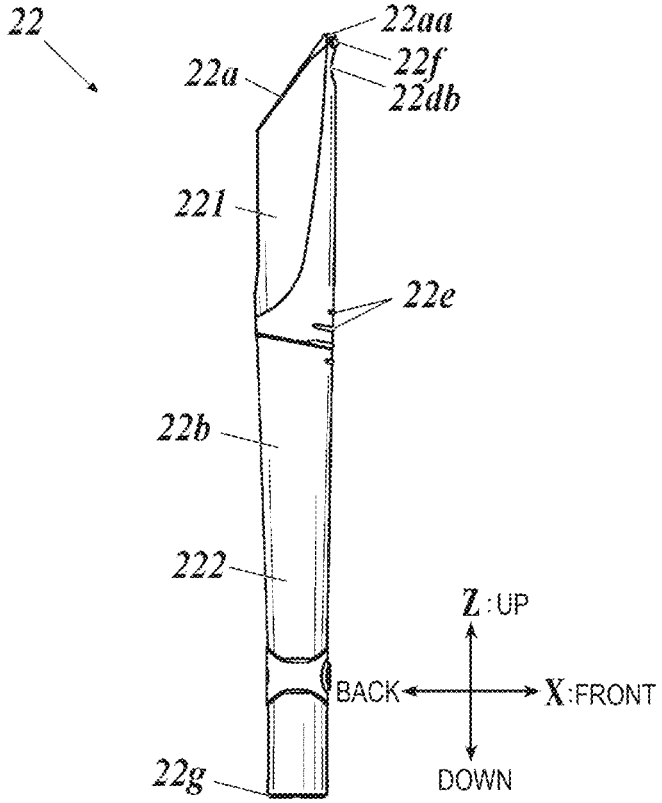

[FIG. 8C]
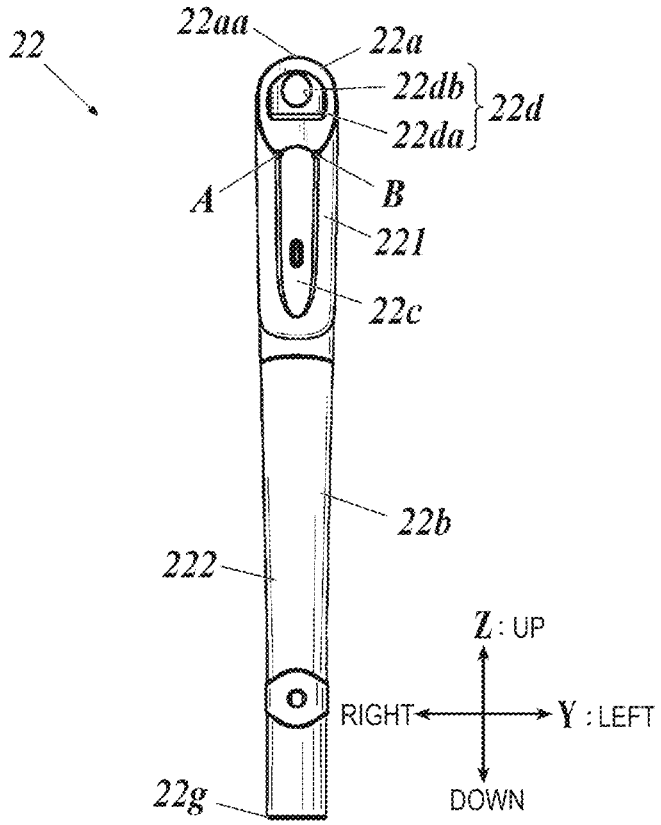
[FIG. 8D]
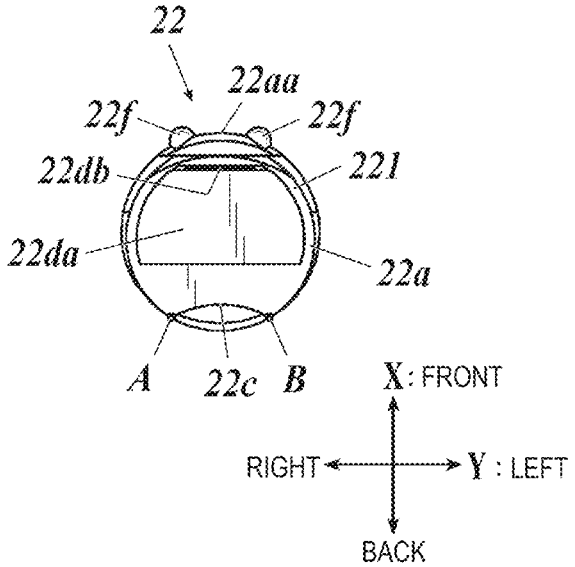

[FIG. 9]
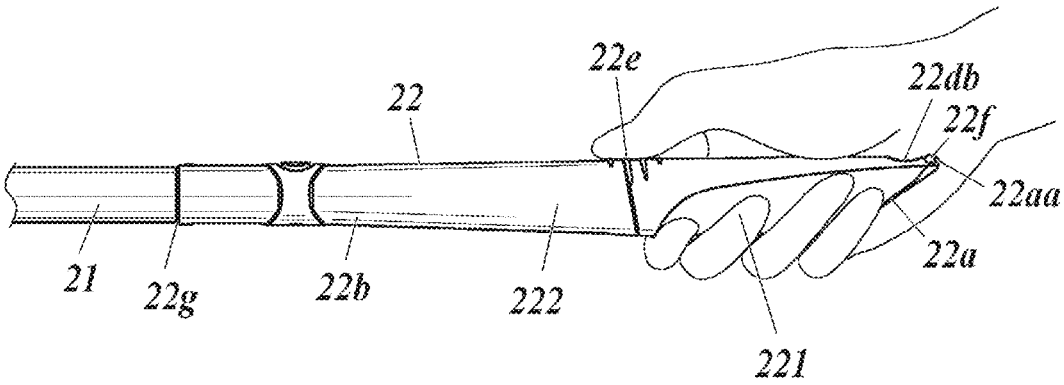
[FIG. 10]
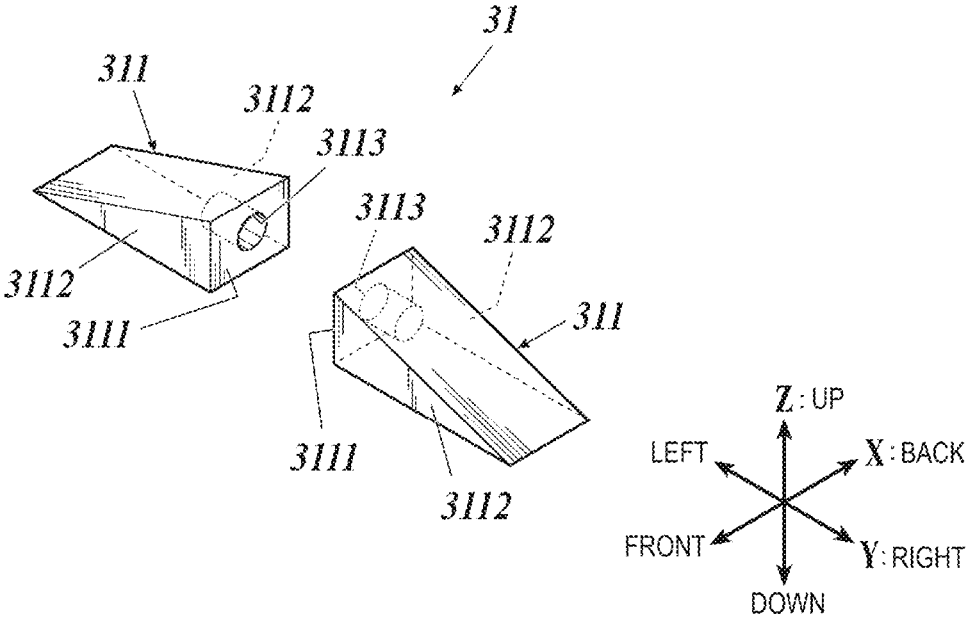

[FIG. 11]
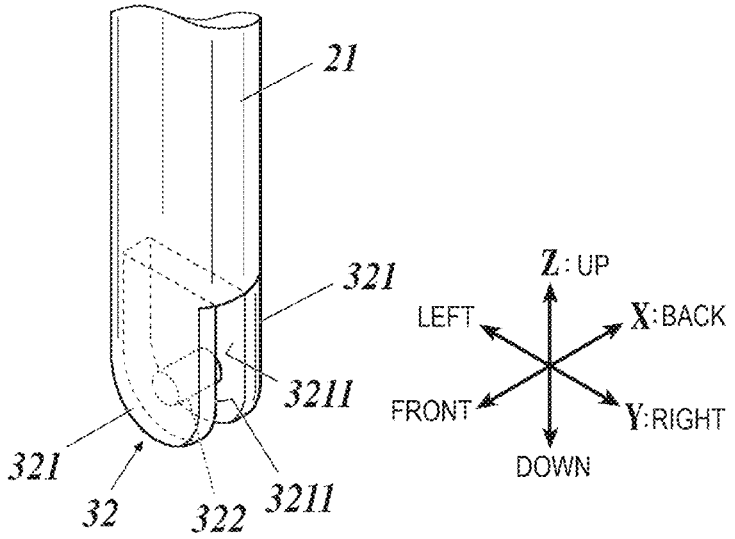
[FIG. 12]
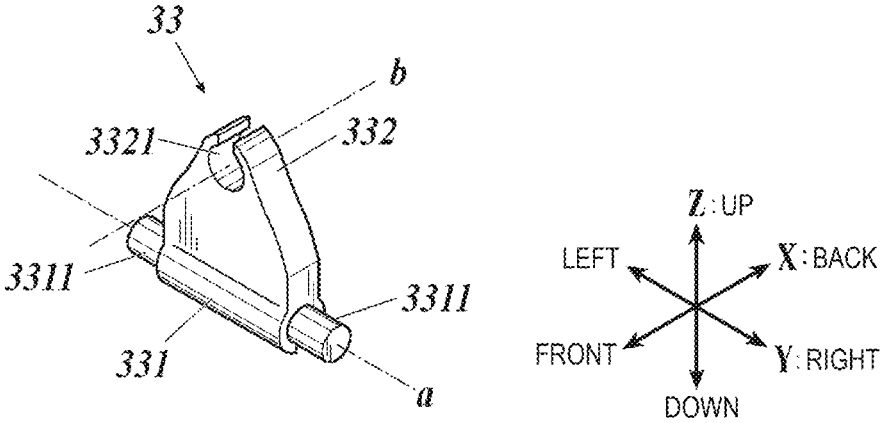

[FIG. 13]
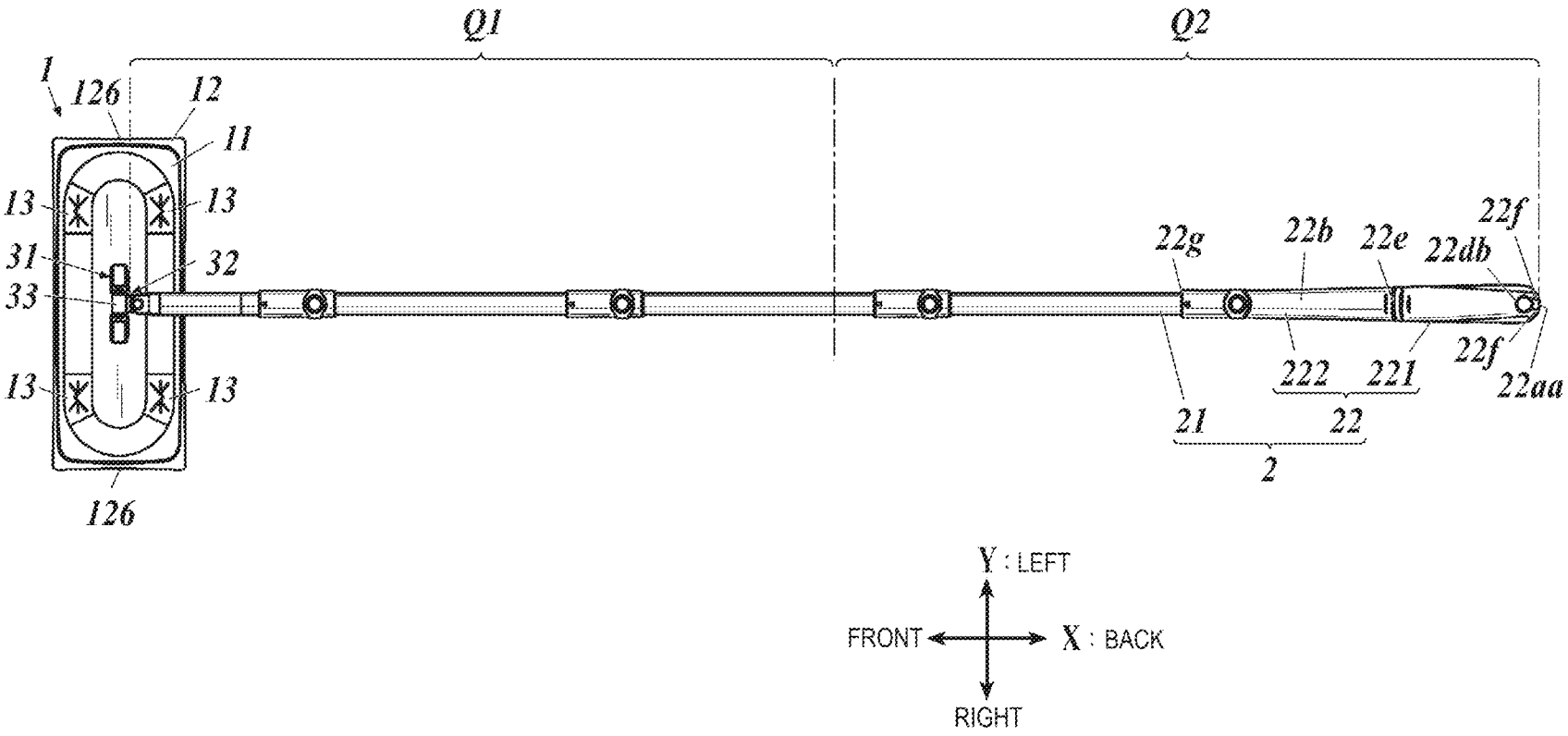

[FIG. 14]
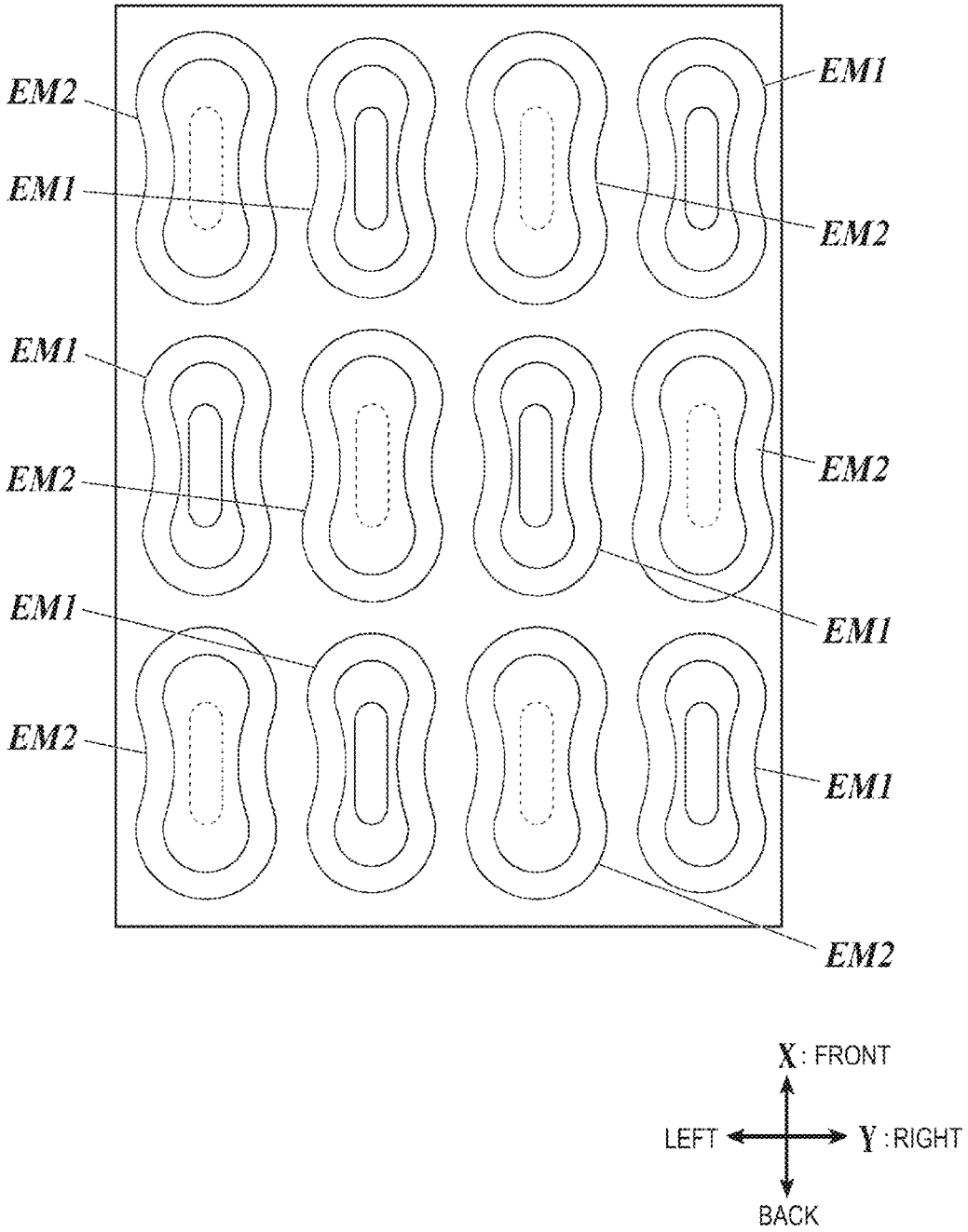

CLEANING TOOL

FIELD

The present invention relates to a cleaning tool.

BACKGROUND

There has been known in the past a cleaning tool for cleaning a floor surface including a head part to which a member for cleaning such as a cleaning sheet is attached, a handle part for gripping the cleaning tool by a user and a joint part for connecting the head part to the handle part, in which the head part and the handle part are rotatably connected through the joint part.

In such cleaning tool, the efficiency of cleaning depends on a shape of the head part to which the member for cleaning is attached, therefore, the shape of the head part is variously devised. For example, there exists a cleaning tool in which a gap of an approximately triangular shape in cross section is held at a peripheral fringe part of a cleaning head to allow a side part of the cleaning head to be easily deformed and to allow the peripheral fringe part of the cleaning head to easily fit to shapes of edge parts on the floor surface and the like at the time of cleating, thereby cleaning the edge parts on the floor surface and the like efficiently (for example, refer to Patent Literature 1).

Patent Literature 1: JP-A-2013-34766

SUMMARY

However, even when the shape of the head part is devised as in the cleaning tool described in the above Patent Literature, a burden of the user is increased and efficiency of cleaning is not improved if a weight of the cleaning tool is not appropriate in accordance with a place to be cleaned. Specifically, when low places such as the floor surface are cleaned, cleaning can be easily performed by using a head part having a certain degree of weight because a center of gravity in the cleaning tool is lowered and a force required to be applied by the user for pressing the floor surface and the like is reduced. On the other hand, when high places such as a ceiling and an upper part of a wall are cleaned, it is preferable that the head part has a light weight in many cases.

An object of the present invention is to provide a cleaning tool capable of easily cleaning both low places such as the floor surface and high places such as the ceiling and the upper part of the wall.

In order to solve the above problems, a cleaning tool according to a first aspect of the present invention includes a head part to which a member for cleaning is attached and a handle part connected to the head part and for being gripped by a user, in which the head part includes a top surface part forming an upper surface side, to which the handle part is connected and a bottom surface part forming a lower surface side, and the bottom surface part is formed to be freely attachable/detachable with respect to the top surface part.

According to the first aspect of the present invention, it is possible to provide the cleaning tool capable of easily cleaning both low places such as the floor surface and high places such as the ceiling and the upper part of the wall.

In the cleaning tool described in the second aspect of the present invention, a center of gravity may be positioned in a part close to the head part when the handle part is divided into two in a longitudinal direction in a state where the handle part is horizontally laid down both in a state where the bottom surface part is attached to the top surface part and a state where the bottom surface part is not attached to the top surface part in the cleaning tool according to the first aspect.

According to the second aspect of the present invention, it is possible to provide the cleaning tool capable of performing cleaning stably both in the state where the bottom surface part is attached and the state where the bottom surface part is not attached.

In the cleaning tool described in the third aspect of the present invention, the bottom surface part may be formed to have a mass of 30 g to 600 g in the cleaning tool according to the first aspect or the second aspect.

According to the third aspect of the present invention, easiness in cleaning low places such as the floor surface can be further improved.

In the cleaning tool described in the fourth aspect of the present invention, the handle part may be capable of adjusting a length, and a center of gravity position may be capable of being changed by changing the length of the handle part in the cleaning tool according to any one of first to third aspects.

According to the fourth aspect of the present invention, it is possible to provide the cleaning tool capable of adjusting the center of gravity position by adjusting the handle part.

In the cleaning tool described in the fifth aspect of the present invention, the handle part may be capable of adjusting a weight, and the center of gravity position may be capable of being changed by changing the weight of the handle part in the cleaning tool according to any one of first to fourth aspects.

According to the fifth aspect of the present invention, it is possible to provide the cleaning tool capable of adjusting the center of gravity position by adjusting the handle part.

Advantageous Effects of Invention

According to the present invention, it is possible to provide the cleaning tool easily cleaning both low places such as the floor surface and high places such as the ceiling and the upper part of the wall.

BRIEF DESCRIPTION OF DRAWINGS

FIG. 1 is a perspective view of a cleaning tool according to an embodiment.

FIG. 2 is a front view of the cleaning tool according to the embodiment. An upper part of a handle part is omitted.

FIG. 3 is a side view of the cleaning tool according to the embodiment. The upper part of the handle part is omitted.

FIG. 4A is a bottom view of a top surface part according to the embodiment.

FIG. 4B is a side view of the top surface part according to the embodiment.

FIG. 5 is a view showing an example of a structure for allowing the top surface part and a bottom surface part to be freely attachable/detachable.

FIG. 6 is a view showing an example of the structure for allowing the top surface part and the bottom surface part to be freely attachable/detachable.

FIG. 7 is a bottom surface view of a head part.

FIG. 8A is a front view of a grip part according to the embodiment.

FIG. 8B is a side view of the grip part according to the embodiment.

FIG. 8C is a back view of the grip part according to the embodiment.

FIG. 8D is a plan view of the grip part according to the embodiment.

FIG. 9 is a view showing a state where a user of the cleaning tool grips the grip part.

FIG. 10 is a perspective view of a first yoke part in a joint part of the cleaning tool according to the embodiment.

FIG. 11 is a perspective view of a lower part of the handle part and a second yoke part in the joint part of the cleaning tool according to the embodiment.

FIG. 12 is a perspective view of a connecting part in the joint part of the cleaning tool according to the embodiment.

FIG. 13 is a view showing a center of gravity position of the cleaning tool.

FIG. 14 is a view showing part of a cleaning sheet used in examples and comparative examples.

DETAILED DESCRIPTION

Hereinafter, specific modes of a cleaning tool 100 according to an embodiment of the present invention will be explained with reference to FIG. 1 to FIG. 13. However, the technical scope of the present invention is not limited to the shown examples.

Explanation will be made by defining X-axis, Y-axis and Z-axis directions as well as a front-and-back direction, a left-and-right direction and an up-and-down direction as shown in FIG. 1.

(Structure of Embodiment)

The cleaning tool 100 includes a head part 1 to which a cleaning sheet P is attached, a handle part 2 for grapping the cleaning tool 100 by a user and a joint part 3 connecting the head part 1 to the handle part 2.

(Head Part)

The head part 1 is formed by a top surface part 11 and a bottom surface part 12 made of different materials, and the handle part 2 is attached to an approximately central part on an upper surface of the top surface part 11 through the joint part 3 as shown in FIG. 1, FIG. 2 and FIG. 3.

(Top Surface Part)

The top surface part 11 is an approximately rectangular member in plan view being elongated in the Y-axis direction with a size of 50 mm to 150 mm, preferably 70 mm to 120 mm in the X-axis direction, and 200 mm to 300 mm, preferably 220 mm to 270 mm in the Y-axis direction, which is formed of a hard material such as ABS resin (acrylonitrile, butadiene, styrene copolymer synthetic resin).

An upper surface side of the top surface part 11 is formed so that portions close to both end parts in the Y-axis direction are higher and portions close to the central part in the Y-axis direction are lower. Raised parts 111 are formed closed to the both end parts in the Y-axis direction and a sunk part 112 is formed close to the central part in the Y-axis direction.

A lower surface side of the top surface part 11 is connected to an upper surface side of the bottom surface part 12.

The top surface part 11 is formed to have a mass of 50 g to 400 g, more preferably, 80 g to 300 g.

(Raised Part)

The raised parts 111 are formed to be raised upward close to the both end parts in the Y-axis direction on the upper surface side of the top surface part 11 in front view as shown in FIG. 2. The raised part 111 is formed so as to gradually raised from the front-and-back direction toward a central part in the X-axis direction so that portions close to the central part in the X-axis direction are highest as shown in FIG. 3.

The raised part 111 is formed so that a thickness of the head part 1 is 10 mm to 30 mm, preferably 15 mm to 25 mm in the highest portion. When the thickness of the head part 1 is lower than 10 mm, it is difficult to insert a finger at the time of attaching the sheet to later-described attachment parts 13 and the sheet comes off easily. When the thickness of the head part 1 is higher than 30 mm, entering to places under furniture with low legs such as under a couch or a rack becomes difficult.

Specific arrangement positions and shapes of the raised parts 111 are not limited to the above can be suitably altered in a condition that the raised parts 111 can be lifted when the handle part 2 climbs over first protruding parts 311.

It is preferable that the raised parts 111 are formed close to the both end parts in a longitudinal direction of the head part 1 in plan view, however, the present invention is not limited to this, and the raised parts 111 are preferably formed close to both end parts in the same direction as a direction in which two first protruding parts 311 of a later-described first yoke part 31 are aligned.

(Sunk Part)

The sunk part 112 is formed so as to gradually sink from the raised parts 111 formed at both end parts in a part close to the central part in the Y-axis direction on the upper surface side of the top surface part 11 as shown in FIG. 2.

The sunk part 112 is formed so that a thickness of the head part 1 is 15 mm or less, preferably 12 mm or less in the central part of the top surface part 11 to which the handle part 2 is attached through the joint part 3.

Ribs 113 protruding downward are formed on the lower surface of the top surface part 11 as shown in FIGS. 4A and 4B. In the ribs 113, high ribs 1131 which are largely convex downward are formed close to the central part of the top surface part 11 in plan view and low ribs 1132 which are convex downward in a lower degree than the high ribs 1131 are formed at other parts as shown in FIG. 4A. The high ribs 1131 are formed so as to be the same height at all places and the low ribs 1132 are formed so as to be gradually reduced in height from the high ribs 1131 toward fringe part directions on the top surface part 11 as shown in FIG. 4B.

The high ribs 1131 are formed so as to protrude downward by 0.5 mm to 5 mm, more preferably, 1 mm to 3 mm from a lower end portion of a fringe part of the top surface part 11 shown in FIG. 4B.

The high ribs 1131 are formed in a range of 10% to 90%, more preferably, 50% to 80% with respect to the whole length in the longitudinal direction of the top surface part 11. The high ribs 1131 are formed in a range of 10% to 75%, more preferably, 30% to 60% with respect to the whole length in a short-side direction of the top surface part 11.

Accordingly, a portion close to the center of the bottom surface part 12 in plan view is strongly pushed by the lower surface of the top surface part 11, and it is possible to collect dust effectively at the portion close to the center of the bottom surface part 12 in plan view. Also in this case, portions close to end parts of the bottom surface part 12 are not pushed strongly, therefore, it is preferable for introducing dust to a lower surface side of the bottom surface part 12.

(Bottom Surface Part)

The bottom surface part 12 is formed of a softer material than that of the top surface part 11, which can be elastically deformed such as TPE (thermoplastic elastomer) so as to have a rectangular shape approximately congruent with the top surface part 11 in plan view as shown in FIG. 1, FIG. 2 and FIG. 3. The bottom surface part 12 is formed to have a thickness of 1 mm to 10 mm, more preferably, 3 mm to 4 mm in the Z-axis direction. The bottom surface part 12 may be formed slightly larger than the top surface part 11.

A rubber hardness of the material to be used is preferably 60 to 100 (a value measured by a durometer type A (Shore A) standardized by JIS K 6253) from a viewpoint of a dust collection property.

The bottom surface part 12 is formed so that the upper surface side is approximately parallel to the lower surface side, and is connected to the top surface part 11 on the upper surface side.

The bottom surface part 12 is formed to have a mass of 30 g to 600 g, more preferably, 50 g to 500 g. When the mass of the bottom surface part 11 is too small, it is necessary for the user to apply a strong force for pressing a floor surface or the like at the time of cleaning low places such as the floor surface with the bottom surface part 12 attached. When the mass of the bottom surface part 11 is too large, the cleaning tool 1 becomes too heavy and the burden of the user is increased, therefore, both cases are not desirable.

The bottom surface part 12 is formed to be freely attachable/detachable with respect to the top surface part 11. The bottom surface part 12 and the top surface part 11 can be freely attached/detached to/from each other by an arbitrary method such that a concave part is provided on the upper surface side of the bottom surface part 12 and a convex part is provided on the lower surface side of the top surface part 11 so that these parts can be fitted to each other.

Specifically, for example, the bottom surface part 12 can be freely attachable/detachable with respect to the top surface part 11 when adopting the following structure.

First, the bottom surface part 12 is formed to be slightly larger than the top surface part 11 in plan view as shown in FIG. 5. Specifically, the bottom surface 12 is formed to be larger than the top surface part 11 in plan view by approximately 0.5 mm to 5 mm, more preferably, 1 mm to 3 mm in the X-axis direction, 0.5 mm to 10 mm, more preferably, 1 mm to 5 mm in the Y-axis direction and 0.5 mm to 20 mm, more preferably, 5 mm to 15 mm at four corners.

Moreover, a fringe convex part 12*a* is formed close to a fringe part in plan view in the bottom surface part 12 so as to extend around a fringe on the upper surface side of the bottom surface 12, and a concave part 12*b* is formed on an inner peripheral side thereof as shown in FIG. 6. The concave part 12*b* is formed so as to be approximately congruent with the top surface part 11.

Furthermore, a rib 12*c* is formed on a slightly inner side of the fringe convex part 12*a* in the concave part 12*b* as shown in FIG. 6, and the fringe of the top surface part 11 is fitted between the fringe convex part 12*a* and the rib 12*c*, thereby allowing both parts to be freely attached/detached to/from each other.

A level difference between the fringe convex part 12*a* and the concave part 12*b* is 0.5 mm to 5 mm, more preferably, 1 mm to 3 mm.

It is not always necessary that the rib 12*c* is formed over the entire periphery as shown in FIG. 6 but may be formed at only part thereof. For example, only ribs formed at portions surrounded in a shape of a semicircle or the like as shown in FIG. 6 may be formed, and the top surface part 11 may be fixed by portions only between these ribs and the fringe convex part 12*a*.

(Flat Surface Part and Recessed Part)

On the lower surface side of the bottom surface part 12, a flat surface part 121, short-side direction recessed parts 122 and longitudinal-direction recessed parts 123 are formed.

(Flat Surface Part)

The flat surface part 121 is a portion formed in an approximately flat surface shape except for later-described linear ribs 124, which is the portion other than the short-side direction recessed parts 122 and the longitudinal-direction recessed parts 123 on the lower surface side of the bottom surface part 12 as shown in FIG. 7.

The bottom surface part 12 corresponds to the entire member formed by an elastically deformable material forming the lower side of the head part 1, and the flat surface part 121 corresponds to a portion formed in the approximately flat surface shape in the lower surface of the bottom surface part 12.

(Short-Side Direction Recessed Part)

The short-side direction recessed parts 122 are portions formed to be recessed upward at positions close to both end parts in the short-side direction (X-axis direction) on the lower surface side of the bottom surface part 12 as shown in FIG. 2 and FIG. 7. According to the parts, portions close to both end parts in the short-side direction (X-axis direction) on the lower surface side of the head part 1 do not closely contact the floor surface, and gaps are generated between the head part 1 and the floor surface at the time of using the cleaning tool 100.

The short-side direction recessed parts 122 can be formed in an arbitrary shape as far as gaps can be generated with respect to the floor surface on the lower surface side close to the both end parts in the short-side direction (X-axis direction) of the head part 1, however, it is preferable that the short-side direction recessed part 122 is formed so that the lower surface side of the bottom surface part 12 is recessed to the largest degree in a central part in the Y-axis direction of an end part on the front side or the back side of the head part 1 and the recess is reduced as going away from that part to be connected to the flat surface part 121 smoothly.

The short-side direction recessed part 122 is formed to be recessed upward by 0.1 mm to 5 mm, more preferably, 0.5 mm to 3 mm as compared with the flat surface part 121 at the most recessed part.

As the short-side direction recessed parts 122 are formed on the lower surface side of the bottom surface part 12, dust on the floor surface is introduced to the lower surface of the head part 1 without being gathered at end parts on front and back of the head part 1 at the time of cleaning the floor surface by moving the cleaning tool 100 in the short-side direction (X-axis direction) of the head part 1, as a result, the dust collection property can be improved.

(Longitudinal-Direction Recessed Part)

The longitudinal-direction recessed parts 123 are portions formed to be recessed upward at positions close to both end parts in the longitudinal direction (Y-axis direction) on the lower surface side of the bottom surface part 12 as shown in FIG. 3 and FIG. 7. According to the parts, portions close to both end parts in the longitudinal direction (Y-axis direction) on the lower surface side of the head part 1 do not closely contact the floor surface, and gaps are generated between the head part 1 and the floor surface at the time of using the cleaning tool 100.

The longitudinal direction recessed parts 123 can be formed in an arbitrary shape as far as gaps can be generated with respect to the floor surface on the lower surface side close to the both end parts in the longitudinal direction (Y-axis direction) of the head part 1, however, it is preferable that the longitudinal direction recessed part 123 is formed so that the lower surface side of the bottom surface part 12 is recessed to the largest degree in a central part in the X-axis direction of an end part on the right side or the left side of the head part 1 and the recess is reduced as going away from that part to be connected to the flat surface part 121 smoothly.

The longitudinal direction recessed part 123 is formed to be recessed upward by 0.1 mm to 5 mm, more preferably, 0.5 mm to 3 mm as compared with the flat surface part 121 at the most recessed part.

As the longitudinal direction recessed parts 123 are formed on the lower surface side of the bottom surface part 12, dust on the floor surface is introduced to the lower surface of the head part 1 without being gathered at end parts on left and right of the head part 1 at the time of cleaning the floor surface by moving the cleaning tool 100 in the longitudinal direction (Y-axis direction) of the head part 1, as a result, the dust collection property can be improved.

(Linear Ribs)

On the flat surface part 121 on the lower surface side of the bottom surface part 12, the linear ribs 124 which are convex downward are formed so as to be a linear shape in bottom view as shown in FIG. 7.

All the linear ribs 124 are formed so as to have the same height in the Z-axis direction, specifically, formed to protrude downward by 0.1 mm to 2 mm, more preferably, 0.2 mm to 1 mm. Each linear rib is formed in a liner shape with a length of 1 mm to 100 mm, more preferably, 8 mm to 85 mm, and with a width of 0.1 mm to 2 mm, more preferably, 0.2 mm to 1.2 mm.

The liner ribs 124 include both ribs formed in the linear shape in bottom view and ribs formed in a curved shape in bottom view.

The linear ribs 124 includes oblique-line ribs 1241 and rhombus-shaped ribs 1242, and specific arrangement is as follows.

(Oblique-Line Ribs)

The oblique-line ribs 1241 are portions other than the rhombus-shaped ribs 1242 in the linear ribs 124, which are formed on the almost entire surface of the flat surface part 121 other than portions where the rhombus-shaped ribs 1242 are formed.

The oblique-line ribs 1241 are formed in linear shapes inclined toward the center in the Y-axis direction from a direction parallel to the X-axis as coming toward the front direction or the back direction from the central part in the X-axis direction on the bottom surface of the head part 1 in bottom view of the head part 1 as shown in FIG. 7.

(Rhombus-Shaped Ribs)

The rhombus-shaped ribs 1242 are portions where the linear ribs are arranged in an approximately rhombus shape in bottom view as shown in FIG. 7, which are formed at a central part in the X-axis direction and the Y-axis direction, two places at midpoints between the central part and end parts in the Y-axis direction and four places near four corners on the lower surface of the head part 1 in the flat surface part 121.

(End-Part Ribs)

End-part ribs 125 formed in a linear shape along the Y-axis direction are formed in the central part in the X-axis direction on the lower surface side close to the both end parts in the longitudinal direction (Y-axis direction) on the lower surface side of the bottom surface part 12.

The end-part ribs 125 are formed to have a height of 1 mm to 5 mm in a lower direction seen from the flat surface part 121. When the height is lower than 1 mm, it is difficult to clean a groove sufficiently, and when the height is higher than 5 mm, a possibility of being an obstruction at the time of cleaning a flat surface on the floor surface is increased. However, it is necessary that the end-part ribs 125 are formed to be higher than the linear ribs 124 in the Z-axis direction.

It is necessary that the end-part ribs 125 are formed to have the above height with respect to the flat surface part 121 also in the case where the end-part ribs 125 are formed so as to overlap with the longitudinal direction recessed parts 123 as shown in FIG. 7.

Moreover, the end-part ribs 125 are formed so that a length in the Y-axis direction is 10 mm to 50 mm, more preferably, 20 mm to 30 mm and a width in the X-axis direction is 0.1 mm to 3 mm, more preferably, 0.5 mm to 1.5 mm.

As the end-part ribs 125 are provided, not only the flat surface on the floor surface but also the groove can be cleaned by allowing the ribs to enter the groove on the floor surface.

(End-Part Protrusions)

In central parts in the X-axis direction in both end parts in the longitudinal direction (Y-axis direction) of the head part 1, end-part protrusions 126 protruding in the Y-axis direction so as to be continued from the end-part ribs 125 are formed as shown in FIG. 1, FIG. 2 and FIG. 7. The end-part protrusions 126 are formed to protrude to the right direction and the left direction from both end parts in the longitudinal direction (Y-axis direction) of the head part 1 by 0.5 mm to 3 mm, more preferably, 0.8 mm to 2 mm.

(Hole Parts)

Hole parts 127 which are convex upward as shown in FIG. 7 are formed close to the both end parts in the longitudinal direction on the lower surface side of the bottom surface part 12. According to the holes, portions close to the both end parts in the longitudinal direction of the bottom surface part 12 becomes flexible, and the bottom surface part 12 can be attached/detached to/from the top surface part 11 easily.

Respective holes forming the hole parts 127 are formed so that the size thereof becomes largest at portions close to four corners of the bottom surface part 12 and reduced as coming close to the end-part ribs 125 in bottom view. Specifically, the holes are formed to have lengths of 3 mm to 15 mm, more preferably, 5 mm to 10 mm as larger sizes and lengths of 1 mm to 5 mm, more preferably, 2 mm to 4 mm as smaller sizes both in the X-axis direction and the Y-axis direction in bottom view.

(Attachment Parts)

The attachment parts 13 are provided close to four corners on the upper surface of the top surface part 11 in plan view as shown in FIG. 1. The attachment parts 13 are holes with claw parts 131 formed of EVA (ethylene-vinyl acetate copolymer) or the like around the holes, which are formed on the raised parts 111 on the upper surface of the top surface part 11. The cleaning sheet P can be attached to the head part 1 by pushing the cleaning sheet P to be caught by the claw parts 131. Specifically, the cleaning sheet P is allowed to closely contact the lower surface side of the bottom surface part 12, and portions of the cleaning sheet P protruding from the lower surface side of the bottom surface part 12 are folded to the upper surface side of the top surface part 11 and pushed into the attachment parts 13 provided on the upper surface side of the top surface part 11, thereby attaching the cleaning sheet P to the head part 1.

The shape of the attachment parts 13 is not limited to the above shape as far as the cleaning sheet P can be attached to the head part 1.

(Handle Part)

The handle part 2 is a bar-shaped member used for being gripped by the user at the time of using the cleaning tool 100, including a handle body 21 and a grip part 22 as shown in FIG. 1. The handle part 2 is rotatably connected to the head part 1 through the joint part 3. Explanation will be made by designating the front-and-back direction, the left and right direction and the up-and-down direction in a state where the handle part 2 stands on the head part 1 vertically as shown in FIG. 1.

(Handle Body)

The handle body 21 is a bar-shaped member formed of a hard material such as ABS resin (acrylonitrile, butadiene, styrene copolymer synthetic resin), metal (aluminum, steel, stainless steel), polycarbonate and polypropylene, which is connected to the approximately central part on the upper surface side of the top surface part 11 in the head part 1 through the joint 3 at a lower end, and connected to the grip part 22 at an upper end part.

The handle body 21 is formed so that a thickness in the front-and-back direction is reduced as compared with a thickness in the left and right direction at a portion close to the lower end part as shown in FIG. 3. Accordingly, it becomes easy to lay the handle part 2 in a lower state.

It is also preferable that the portion close to the lower end part of the handle body 21 is formed to have the same thickness in the front/back direction and the right/left direction though the effect that the handle part 2 can be easily laid in the lower state is reduced. The thickness in the front-and-back direction may be larger than the thickness in the left and right direction by giving weight to, for example, strength of later-described second protruding parts 321.

The handle body 21 may be formed so as to be divided into plural portions as shown in FIG. 13.

The handle body 21 is formed to have a length of 500 mm to 1000 mm, more preferably, 600 mm to 900 mm in the Z-axis direction. The handle body 21 is formed to have a mass of 50 g to 300 g, more preferably, 100 g to 250 g.

(Grip Part)

The grip part 22 is a part gripped by the user at the time of using the cleaning tool 100 in the handle part 2, which is connected to the handle body 21 at a lower end part.

The grip part 22 is formed to have a length of 100 mm to 400 mm, more preferably, 250 mm to 350 mm in the Z-axis direction, and to have an approximately circular shape with a diameter of 15 mm to 45 mm, more preferably, 20 mm to 40 mm at the thickest part in plan view. The grip part 22 is also formed to have a mass of 30 g to 200 g, more preferably, 50 g to 100 g.

The grip part 22 may be formed as a separate member from the handle body 21 as in the embodiment as well as may be integrally formed.

(Inclined Surface)

An upper surface of the grip part 22 is formed to be inclined in one direction with respect to a surface (XY surface) perpendicular to the Z-axis to form an inclined surface 22*a* as shown in FIG. 8B. The inclined surface 22*a* is formed so as to be inclined by 30 degrees to 80 degrees, more preferably, 40 degrees to 70 degrees with respect to the XY surface. A point where the inclined surface 22*a* is the highest in the Z-axis direction, namely, a front end part of the inclined surface 22*a* is a tip end 22*aa*.

(Peripheral Surface)

A peripheral surface 22*b* of the grip part 22, namely, a surface other than the inclined surface 22*a* on the upper surface and a lower surface connected to the handle body 21 in outer surfaces of the grip part 22 is formed to have a cross-sectional shape in which a diameter is gradually increased toward the upper part except for portions close to the lower end part and the upper end part where the inclined surface 22*a* is formed as shown in FIG. 8A to FIG. 8B.

(Groove Part)

As shown in FIG. 8C and FIG. 8D, a groove part 22*c* in which the handle body is concave in a groove shape in the X-axis direction is formed on a side in which the inclined surface 22*a* is lowered in the Z-axis direction, namely, the back side at an upper part of the grip part 22.

The groove part 22*c* is formed to have a depth of 0.5 mm to 5 mm, more preferably, 1 mm to 3 mm in the X-axis direction, to have a width of 5 mm to 30 mm, more preferably, 10 mm to 20 mm in the Y-axis direction and to have a length of 30 mm to 100 mm, more preferably, 40 mm to 70 mm in the Z-axis direction.

(Hole Part)

A hole part 22*d* piercing from the inclined surface 22*a* to a tip end 22*aa* side, namely, the front side at the upper part of the peripheral surface 22*b* is formed at a portion close to the upper end part of the grip part 22 as shown in FIG. 8A to FIG. 8D.

The hole part 22*d* includes a depressed part 22*da* in which the inclined surface 22*a* is depressed widely in a concave shape and a through hole 22*db* piercing from the depressed part 22*da* to the tip end 22*aa* side at the upper part of the peripheral surface 22*b* as shown in FIG. 8C and FIG. 8D.

The hole part 22*d* is formed so that the through hole 22*db* is a circular hole in plan view with a diameter of 5 mm to 20 mm, more preferably, 8 mm to 15 mm.

(Non-Slip Part)

On the tip-end 22*aa* side, namely, the front side of the peripheral surface 22*b* of the grip part 22, a non-slip part 22*e* in which the surface of the peripheral surface 22*b* is raised at plural places in a horizontal linear shape is formed as shown in FIG. 8A and FIG. 8B.

Plural linear protrusions forming the non-slip part 22*e* are formed so that each protrusion has a height of 0.1 mm to 2 mm, more preferably, 0.5 mm to 1 mm in the X-axis direction, a length of 5 mm to 50 mm, more preferably, 10 mm to 40 mm in the Y-axis direction and a width of 1 mm to 5 mm, more preferably, 1.5 mm to 3 mm in the Z-axis direction. It is desirable that the linear protrusions forming the non-slip part 22*e* are formed at intervals of 2 mm to 10 mm, more preferably, 3 mm to 6 mm in the Z-axis direction.

The non-slip part 22*e* is formed at a position where a tip of a thumb contacts when the user of the cleaning tool 100 grips the grip part 22 as shown in FIG. 9, specifically, at a position where a distance from the upper end part of the grip part 22 is 30 mm to 250 mm, more preferably, 70 mm to 180 mm.

Though the case in which four linear protrusions are formed as the non-slip part 22*e* is shown in FIG. 8A and FIG. 8B, the structure of the non-slip part 22*e* is not limited to this. Linear protrusions larger or smaller in number may be formed, and the non-slip part may be formed by protrusions other than linear protrusions such as punctiform protrusions. It is also preferable that the non-slip part 22*e* is formed by sticking some material with a high frictional resistance on the surface.

(Protruding Part)

Two protruding parts 22*f* protruding toward the front direction are provided side by side in the Y-axis direction at portions close to the tip end 22*aa* of the peripheral surface 22*b* as shown in FIG. 8A, FIG. 8B and FIG. 8D.

Respective protruding parts 22*f* are formed in a spherical shape with a side contacting the peripheral surface 22*b* being cut as shown in FIG. 8A, FIG. 8B and FIG. 8D so that a diameter of the sphere is 1 mm to 10 mm, more preferably, 2 mm to 6 mm. The protruding parts 22*f* are formed to have a height from the peripheral surface 22*b* is 0.5 mm to 5 mm, more preferably, 1 mm to 3 mm.

The number of protruding parts 22*f* is not always limited to two as far as plural points contact a wall when the handle part 2 is leaned on the wall so that the tip end 22*aa* side faces the wall, and a larger number of protruding parts 22*f* may be provided. The shape is also not limited to the spherical shape.

(Connecting Part)

A connecting part 22*g* used for connecting to the handle body 21 is provided at a lower part of the grip part 22 as shown in FIG. 8A to FIG. 8C, and the grip part 22 is fitted to the upper part of the handle body 21 to be freely attachable/detachable by using the connecting part 22*g*.

An arbitrary structure may be adopted as the structure of the connecting part 22*g* as far as two bar-shaped members can be connected so as to be freely detachable/attachable.

It is also preferable that the grip part 22 does not have the connecting part 22*g* and that the handle body 21 is formed integrally with the grip part 22.

(Soft Part)

A soft part 221 is formed by a softer material as compared with a later-described hard part 222 such as thermoplastic elastomers (styrene-based, olefin-based), urethane and EVA resin. The soft part 221 is preferably formed of a material with a rubber hardness 60 to 100 (a value measured by the durometer type A (Shore A) standardized by JIS K 6253) as a specific hardness.

The soft part 221 is formed so as to cover around left and right of an upper part of the peripheral surface 22*b* of the grip part 22 from the side where the inclined surface 22*a* is lowered, namely, the back side and so as not to cover the tip end 22*aa* side where the inclined surface 22*a* is increased in height, namely, the front side.

The soft part 221 covers the approximately entire inclined surface 22*a* except for part of the front side where the inclined surface 22*a* is increased in height, and the entire inner surface of the depressed part 22*da* is also covered with the soft part 221 as shown in FIG. 8D.

The soft part 221 is formed so as to cover the entire range in which fingers from a forefinger to a little finger reach when the user of the cleaning tool grips the grip part 22 as shown in FIG. 9. Specifically, the soft part 221 is preferably formed from an upper end of the grip part 22 to a position approximately 40 mm to 230 mm, more preferably, 60 mm to 160 mm downward from the upper end.

(Hard Part)

The hard part 222 is a part forming a body of the grip part 22, which is the entire part of the grip part 22 other than the soft part 221.

The hard part 222 is formed of a harder material as compared with the soft part 221 such as plastic resin (polypropylene).

As the soft part 221 is formed, the hard part 222 exists to an end part on the opposite side of a side connected to the handle body 21 in the peripheral surface 22*b* on the front side of the grip part 22, namely, to an upper end part as shown in FIG. 8A and FIG. 8B.

(Joint Part)

The joint part 3 is formed by the first yoke part 31 provided in the approximately central part on the upper surface side of the top surface part 11 in the head part 1, a second yoke part 32 provided at a lower end part of the handle part 2 and a connecting part 33 connecting the first yoke part 32 and the second yoke part 33 as shown in FIG. 1, FIG. 2 and FIG. 3.

(First Yoke Part)

The first yoke part 31 is formed by two symmetrical first protruding parts 311 facing at first facing surface parts 3111, which are formed integrally with the top surface part 11 at the central part on the upper surface side of the top surface 11 in the head part 1 as shown in FIG. 1, FIG. 2, FIG. 3 and FIG. 10. In the embodiment, a portion used for connecting to another member, which is formed with two symmetrical protrusions is called the "yoke part".

(First Protruding Part)

The first protruding parts 311 are formed so as to be gradually increased in height toward the first facing surface parts 3111 where the first protruding parts 311 face each other when seen from the X-axis direction and are arranged side by side in the Y-axis direction as shown in FIG. 1, FIG. 2, FIG. 3 and FIG. 10.

The first protruding parts 311 are each formed to have 5 mm to 20 mm, more preferably, 8 mm to 15 mm in the X-axis direction and to have 10 mm to 50 mm, more preferably, 15 mm to 30 mm in the Y-axis direction. The first protruding parts 311 are formed to have 5 mm to 15 mm, more preferably, 8 mm to 12 mm in the Z-axis direction so as to be the same height or higher than the raised parts 111 at portions close to the first facing surface parts 3111 at the highest part. The first protruding parts 311 are arranged so that the first facing surface parts 3111 have a clearance of 10 mm to 25 mm, more preferably, 15 mm to 20 mm therebetween.

(First Facing Surface Parts)

The first facing surface parts 3111 are surfaces where the first protruding parts 311 face each other as shown in FIG. 1, FIG. 2 and FIG. 10, which are formed to have an approximately rectangular shape standing almost vertically from the upper surface side of the top surface part 11 so that the first facing surface parts 311 are parallel to each other.

Moreover, hole parts 3113 are formed in the first facing surface parts 3111 as shown in FIG. 10.

(Hole Parts)

The hole parts 3113 are cylindrical holes formed in the first facing surface parts 3111, which are used for connecting to a first rotating axial center part 331 of the connecting part 33, which is described later.

(Side Surface Parts)

Side surface parts 3112 are surfaces facing the X-axis direction in parallel to a YZ plane in the first protruding parts 311 and formed continuously from front and back both sides of the first facing surface parts 3111, which are formed so as to stand almost vertically from the upper surface side of the top surface part 11 in the head part 1.

(Second Yoke Part)

The second yoke part 32 is formed by two symmetrical second protruding parts 321 extending in the axial direction at a lower end part of the handle body 21 in the handle part 2 and a second axial member 322 stretched over between second facing surface parts 3211 of the second protruding parts 321 as shown in FIG. 1, FIG. 2, FIG. 3 and FIG. 11.

(Second Protruding Part)

The second protruding parts 321 are integrally formed with the handle body 21 so that the second facing surface parts 3211 face each other in parallel at both end parts in the X-axis direction in the state shown in FIG. 1 at the lower end of the handle body 21 as shown in FIG. 1, FIG. 3 and FIG. 11.

The second protruding parts 321 each have a thickness of 2 mm to 6 mm, more preferably, 3 mm to 5 mm in the X-axis direction and a width approximately the same as that of the handle body 21 in the Y-axis direction in the state shown in FIG. 1. When the thickness in the X-axis direction is too thin, strength is insufficient when being pressed at the time of cleaning, which leads to breakage easily. When the thickness is too thick, the handle interferes with an upper surface of the head part when the handle is laid in the X-direction, and it is difficult to lean the handle to an approximately parallel state.

The second facing surface parts 3211 are arranged so as to have a clearance of 2 mm to 10 mm, more preferably, 3 mm to 7 mm therebetween.

(Second Axial Member)

The second axial member 322 is formed integrally with the second protruding parts 321 so as to be stretched along the X-axis direction in the central part in the Y-axis direction between the second facing surface parts 3211 as shown in FIG. 11.

(Connecting Part)

The connecting part 33 is provided in a manner of being interposed between the first yoke part 31 and the second yoke part 32 as shown in FIG. 1, FIG. 2 and FIG. 3, which is formed in an approximately triangular shape when seen from the X-axis direction and includes the first rotating axial center part 331 and a second rotating axial center part 332 central axes of which are orthogonal to each other without crossing each other in a manner of crossing three-dimensionally as shown in FIG. 12.

As a material for forming the connecting part 33, for example, polyacetate is used.

(First Rotating Axial Center Part)

The first rotating axial center part 331 is a portion used for connecting to the first yoke part 31 formed in the lower end part of the connecting part 33, including columnar protruding parts 3311 at both end parts in the Y-axis direction.

The first rotating axial center part 331 is formed so that a width of a portion other than the protruding parts 3311 in the Y-axis direction is approximately the same as the clearance between the first facing surface parts 3111 of the first protruding parts 311 as well as the protruding parts 3311 have the approximately the same shape as the hole parts 3113. Therefore, the connecting part 33 can be attached to the first yoke part 31 so as to rotate about the Y-axis direction by fitting the protruding parts 3311 to the hole parts 3113.

A central axis of the first rotating axial center part 331 shown in FIG. 12 along the Y-axis direction is set as a first axial center "a".

(Second Rotating Axial Center Part)

The second rotating axial center part 332 is a portion used for connecting to the second yoke part 32 formed in an upper end part of the connecting part 33 as shown in FIG. 12, having a second mounting hole part 3321 having an approximately cylindrical shape piercing in the front and back direction with part in the upper end part being cut out. A diameter of a cylindrical space formed inside the second mounting hole part 3321 is approximately the same as a diameter of the second axial member 322. A length in the X-axis direction is formed to be approximately the same as a length of the second axial member 322, and the connecting part 33 can be fixed to the second yoke part 32 so as to rotate about the X-axis direction by fitting the second axial member 322 to the second mounting hole part 3321.

A central axis of the second rotating axial center part 332 shown in FIG. 12 along the X-axis direction is set as a second axial center "b".

(Center of Gravity Position of Cleaning Tool)

In the cleaning tool 100, weights of the head part 1 and the handle part 2 are adjusted so that the center of gravity is positioned in a part close to the head part 1 (Q1 in FIG. 13) when the handle part 2 is divided into two in the longitudinal direction in a state where the handle part 2 is horizontally laid down as shown in FIG. 13 both in a state where the bottom surface part 12 is attached to the head part 1 and a state where the bottom surface part 12 is not attached to the head part 1.

Specifically, the above center of gravity can be realized by setting, for example, a mass of the top surface part 11 to 114.5 g, a mass of the bottom surface part 12 to 65.7 g and the entire mass of the handle part 2 to 197.8 g.

Advantages of Embodiment

According to the embodiment, the head part 1 can be increased in weight by attaching the bottom surface part 12 to the head part 1 when cleaning low places such as the floor surface. Accordingly, the force necessary for the user to press the floor surface is reduced and cleaning of low places such as the floor surface can be performed easily.

At the time of cleaning high places such as the ceiling and the upper part of the wall, the head part 1 can be reduced in weight by removing the bottom surface part 12 from the head part 1. Accordingly, the burden of the user at the time of cleaning high places can be reduced.

According to the embodiment, weights of the head part 1 and the handle part 2 are adjusted in the cleaning tool 100 so that the center of gravity is positioned at the part close to the head part 1 (Q1 in FIG. 13) when the handle part 2 is divided into two in the longitudinal direction in the state where the handle part 2 is horizontally laid down both in the state where the bottom surface part 12 is attached to the head part 1 and the state where the bottom surface part 12 is not attached to the head part 1. Accordingly, cleaning can be performed stably in both states.

That is, in both cases of cleaning low places such as the floor surface and cleaning high places such as the ceiling and the upper part of the wall, it becomes difficult to perform cleaning when the center of gravity of the cleaning tool is positioned too close to a user's hand as well as when it is positioned in the head part far from the user. Therefore, it is desirable that the center of gravity is positioned at the lower half part of the handle part 2.

According to the embodiment, the center of gravity position is positioned in the above position in both cases where low places such as the floor surface are cleaned by attaching the bottom surface part 12 and where high places such as the ceiling and the upper part of the wall are cleaned by removing the bottom surface part 12, therefore, cleaning can be performed easily.

Also according to the embodiment, the mass of the bottom surface part 12 is set in a suitable range, specifically, in a range of 30 g to 600 g, more preferably, 50 g to 500 g, thereby further facilitating the cleaning of low places such as floor surface.

Further according to the embodiment, the bottom surface part 12 can be removed from the top surface part 11, therefore, the bottom surface part 12 can be washed alone. Accordingly, the bottom surface part 12 easily getting dirty at the time of cleaning can be washed by removing the bottom surface part 12 alone, therefore, maintenance of the cleaning tool can be performed easily.

Modification Example 1

The center of gravity position may be changed by changing the length of the handle by allowing the handle part 2 to be divided into plural parts.

Specifically, it is desirable that the length of the handle part 2 can be changed to be 70 to 80%, 50 to 60% and 30 to 40% with respect to the longest case. For example, the entire length of the handle part 2 is allowed to be changed in four stages of 1100 mm, 860 mm, 615 mm and 375 mm. Accordingly, the length of the handle part 2 can be changed to lengths of 78%, 56% and 34% with respect to the longest case of 1100 mm.

A means for changing the length of the handle part 2 is not limited to the method of dividing the handle part 2 into plural parts. For example, the length can be changed by forming the handle part 2 so as to freely extend and contract.

Modification Example 2

The center of gravity position may be changed by changing a weight ratio between the head part 1 and the handle part 2 by allowing the handle part 2 to be divided into plural parts.

Specifically, it is desirable that the weight of the head part 1 can be changed to be 85 to 95%, 110 to 120%, 150 to 160% and 230 to 250% with respect to the weight of the handle part 2. For example, when the mass of the head part 1 is 180 g, the mass of the handle part 2 is allowed to be changed in four stages of 197.8 g. 157.3 g, 116.6 g and 76.1 g. Accordingly, the weight of the head part 1 can be changed to be 91%, 114%, 154% and 236% with respect to the weight of the handle part 2.

A means for changing the weight of the handle part 2 is not limited to the method of dividing the handle part 2 into plural parts. For example, the weight can be changed by attaching a given weight to the handle part 2 and attaching/detaching the weight.

EXAMPLES

Next, results obtained by evaluating easiness in cleaning low places such as the floor surface and high places such as the ceiling and the upper part of the wall using cleaning tools according to examples and comparative examples of the present invention will be explained. The present invention will be specifically explained by examples below, and the present invention is not limited to these examples.

Example 1

In the head part 1, the top surface part 11 was formed in a rectangular shape in plan view with a long side of 240 mm and a short side of 95 mm by using ABS resin, and the bottom surface part 12 was formed in a rectangular shape in plan view with a long side of 248 mm and a short side of 98 mm by using elastomer (TPE) having a hardness of 70 degrees. The top surface part 11 and the bottom surface part 12 are formed to be freely attachable/detachable. The head part 1 was formed so that a mass of the top surface part 11 is 114.5 g and a mass of the bottom surface part 12 is 20 g.

The handle part 2 was formed so that a length from the connection part with respect to the head part 1 to the upper end of the grip part 22 is 1120 mm and a mass is 197.8 g.

In the handle part 2 according to the example, the handle body 21 can be divided into plural parts as shown FIG. 13, and masses of respective parts were measured in a state where the lowest portion of the handle part 2 is connected to the head part 1. Therefore, the mass of the top surface part 11 includes a mass of the lowest end portion of the handle body 21, and the mass of the handle part 2 does not include the mass of that portion.

The lower surface of the bottom surface part 12 in the above cleaning tool was formed as follows.

The linear ribs 124 were formed so that the oblique-line ribs 1241 had a curved shape with a length of 10 mm to 80 mm and the rhombus-shaped ribs 1242 had a size of 50 mm in the X-axis direction and 28 mm in the Y-axis direction as a larger one and a size of 14 mm in the X-axis direction and 11 mm in the Y-axis direction as a smaller one by linear ribs with 0.3 mm in the lower direction and a width of 1 mm.

The oblique-line ribs 1241 were arranged at intervals of 6 mm at the narrowest part and 9 mm at the widest part. Four rhombus-shaped ribs 1242 were arranged at positions 10 mm in oblique directions from four corners, one in the center and two in middle positions between the center and end parts.

The end-part ribs 125 were formed so that a height from the flat surface part on the lower surface of the bottom surface part was 2 mm in the lower direction, a length in the Y-axis direction was 23 mm and a width in the X-axis direction was 1 mm, and the end-art protrusions 126 were formed so that a height from the flat surface part on the lower surface of the bottom part was 2 mm in the lower direction and 1.5 mm in the Y-axis direction.

Thirty-six oblique-line ribs 1241, seven rhombus-shaped ribs 1242 including larger ones and smaller ones and two end-part ribs 125 including left and right ones were formed.

As the cleaning sheet P, a dry sheet formed in a rectangular shape with a long side of 300 mm and a short side of 200 mm, having a 100 gsn in weighing, to which emboss processing was performed was used. Specifically, the cleaning sheet P was formed to have convex embosses EM1 and concave embosses EM2 as shown in FIG. 14, so that each emboss had 8 mm in a long-side direction, 3 mm in a short-side direction and 0.8 mm in height. A direction in which the emboss is elongated in plan view, namely, the X-axis direction in FIG. 14 is the long-side direction, and a direction in which the emboss is short in plan view, namely, the Y-axis direction in FIG. 14 is the short-side direction.

Moreover, non-woven fabric mainly composed of polyethylene-telephralate was used as a hydrophilic fiber for an outer layer of the cleaning sheet, and a fiber mainly composed of polypropylene was used as a hydrophilic fiber for an inner layer of the cleaning sheet.

Concerning details of the composition of the outer layer, a chemical fiber mainly composed of polyethylene-telephralate, polypropylene, polyethylene and the like is adopted. Specifically, the outer layer is composed of 100% hydrophilic fiber, in which 80% polyethylene-telephralate is contained as the hydrophilic fiber and 20% core-sheath fiber of polypropylene and polyethylene as a binder fiber. The polyethylene-telephralate fiber with a fineness of 3.3 dtex and the binder fiber with a fineness of 1.7 dtex were used.

The inner layer is formed of spun bond non-woven fabric of 100% polypropylene.

Spun lace non-woven fabric of a three-layer structure including the inner layer and the outer layer is formed by water-flow interlacing.

Although the dry sheet was used in the embodiment, a wet sheet can be used.

Example 2

The bottom surface part 12 was formed to have a mass of 30 g. Other structures are the same as those of Example 1.

Example 3

The bottom surface part 12 was formed to have a mass of 50 g. Other structures are the same as those of Example 1.

Example 4

The bottom surface part 12 was formed to have a mass of 65.7 g. Other structures are the same as those of Example 1.

Example 5

The bottom surface part 12 was formed to have a mass of 200 g. Other structures are the same as those of Example 1.

Example 6

The bottom surface part 12 was formed to have a mass of 500 g. Other structures are the same as those of Example 1.

Example 7

The bottom surface part 12 was formed to have a mass of 600 g. Other structures are the same as those of Example 1.

Example 8

The bottom surface part 12 was formed to have a mass of 700 g. Other structures are the same as those of Example 1.

Comparative Example 1

The bottom surface part 12 was not allowed to be removed from the top surface part 11 and to have a mass of 200 g. Other structures are the same as those of Example 1.

Comparative Example 2

The bottom surface part 12 was not allowed to be removed from the top surface part 11 and to have a mass of 30 g. Other structures are the same as those of Example 1.

Comparative Example 3

The bottom surface part 12 was not allowed to be removed from the top surface part 11 and to have a mass of 50 g. Other structures are the same as those of Example 1.

Comparative Example 4

The bottom surface part 12 was not allowed to be removed from the top surface part 11 and to have a mass of 65.7 g. Other structures are the same as those of Example 1.

Comparative Example 5

The bottom surface part 12 was not allowed to be removed from the top surface part 11 and to have a mass of 200 g. Other structures are the same as those of Example 1.

Comparative Example 6

The bottom surface part 12 was not allowed to be removed from the top surface part 11 and to have a mass of 500 g. Other structures are the same as those of Example 1.

Comparative Example 7

The bottom surface part 12 was not allowed to be removed from the top surface part 11 and to have a mass of 600 g. Other structures are the same as those of Example 1.

Comparative Example 8

The bottom surface part 12 was not allowed to be removed from the top surface part 11 and to have a mass of 700 g. Other structures are the same as those of Example 1.

Comparative Example 9

The head part 1 is formed not to have the bottom surface part 12. Other structures are the same as those of Example 1.

The floor surface, the ceiling and the upper part of the wall were cleaned by a subject by using the cleaning tools of the above examples and comparative examples, and sensory evaluation concerning easiness in cleaning was performed. In the cleaning tools to/from which the bottom surface part 12 can be freely attached/detached, cleaning was performed by attaching the bottom surface part 12 at the time of cleaning the floor surface, and cleaning was performed without attaching the bottom surface part 12 at the time of cleaning the ceiling and the upper part of the wall.

Test results are shown in Table 1. Evaluation criteria are as follows:

Excellent: Cleaning was performed extremely easily with satisfaction,

Good: Cleaning was performed easily with almost satisfaction,

Fair: Cleaning was sufficiently performed though cleaning was not performed easily in some aspects, and Poor: Cleaning was not performed easily with no satisfaction.

TABLE 1

| | Presence of bottom surface part | Whether bottom surface part is attachable/detachable | Mass of bottom surface part | easiness in cleaning of floor surface | easiness in cleaning of ceiling/upper part of wall |
|---|---|---|---|---|---|
| Example 1 | present | attachable/detachable | 20 g | fair | excellent |
| Example 2 | present | attachable/detachable | 30 g | good | excellent |
| Example 3 | present | attachable/detachable | 50 g | excellent | excellent |
| Example 4 | present | attachable/detachable | 65.7 g | excellent | excellent |
| Example 5 | present | attachable/detachable | 200 g | excellent | excellent |
| Example 6 | present | attachable/detachable | 500 g | excellent | excellent |
| Example 7 | present | attachable/detachable | 600 g | good | excellent |
| Example 8 | present | attachable/detachable | 700 g | fair | excellent |
| Comparative Example 1 | present | not attachable/detachable | 20 g | fair | poor |

TABLE 1-continued

| | Presence of bottom surface part | Whether bottom surface part is attachable/detachable | Mass of bottom surface part | easiness in cleaning of floor surface | easiness in cleaning of ceiling/upper part of wall |
|---|---|---|---|---|---|
| Comparative Example 2 | present | not attachable/detachable | 30 g | good | poor |
| Comparative Example 3 | present | not attachable/detachable | 50 g | excellent | poor |
| Comparative Example 4 | present | not attachable/detachable | 65.7 g | excellent | poor |
| Comparative Example 5 | present | not attachable/detachable | 200 g | excellent | poor |
| Comparative Example 6 | present | not attachable/detachable | 500 g | excellent | poor |
| Comparative Example 7 | present | not attachable/detachable | 600 g | good | poor |
| Comparative Example 8 | present | not attachable/detachable | 700 g | fair | poor |
| Comparative Example 9 | not present | — | | poor | excellent |

(Evaluation)

According to comparison between Examples 1 to 8 and Comparative Examples 1 to 9, it is found that the cleaning tool realizing both easiness in cleaning the floor surface and easiness in cleaning the ceiling and the upper part of the wall by forming the bottom surface part 12 so as to be freely attachable/detachable with respect to the top surface part 11 can be obtained.

That is, concerning the cleaning of the floor surface, evaluations are "fair" at worst in Examples 1 to 8 and Comparative Examples 1 to 8 in which cleaning can be performed with the bottom surface part 12, however, the evaluation is "poor" in Comparative Example 9 in which the bottom surface part is not allowed to be provided.

Concerning the cleaning of the ceiling and the upper part of the wall, the evaluations are all "excellent" in Examples 1 to 8 and Comparative example 9 as cleaning can be performed by removing the bottom surface part 12 to make the head part 1 light in weight, however, evaluations are all "poor" in Comparative Examples 1 to 8 in which the bottom surface part 12 is not allowed to be removed.

According to the results, it is found that easiness in cleaning can be realized both in the floor surface and in the ceiling and the upper part of the wall only in the case of Examples 1 to 8 in which the bottom surface part 12 can be freely attached/detached to/from the top surface part 11.

According to comparison between Examples 1, 8 and Examples 2 to 7, it is also found that easiness in cleaning of the floor surface can be improved by setting the mass of the bottom surface part 12 to 30 g to 600 g.

Furthermore, according to comparison between Examples 2, 7 and Examples 3 to 6, it is found that easiness in cleaning of the floor surface can be further improved by setting the mass of the bottom surface part 12 to 50 g to 500 g.

INDUSTRIAL APPLICABILITY

The present invention can be suitably utilized in a manufacturing field of the cleaning tool.

The invention claimed is:

1. A cleaning tool comprising:

a head part to which a member for cleaning is attached; and a handle part connected to the head part and for being gripped by a user, wherein the head part includes a top surface part forming an upper surface side, to which the handle part is connected and a bottom surface part forming a lower surface side, and the bottom surface part is formed to be freely attachable or detachable with respect to the top surface part, wherein a length of the handle part is capable of changing to be 78%, 56% and 34% with respect to the longest case, wherein the top surface part is an approximately rectangular member in plan view being elongated in a Y-axis direction, a X-axis direction is perpendicular to the Y-axis in the plan view, raised parts are formed on the upper surface side of the top surface part, the raised parts are close to both ends of the top surface part in the Y-axis direction, the raised parts are higher than a sunk part which is close to a central part of the top surface part in the Y-axis direction, and a height of the top surface is gradually sink from the raised parts to the sunk part, wherein ribs protruding downward are formed on a lower surface of the top surface part, the ribs comprise high ribs which are largely convex downward and formed close to the central part of the top surface part in plan view and low ribs which are convex downward in a lower degree than the high ribs and formed at portions other than the central part, the high ribs are formed so as to be largely convex downward and the low ribs are formed so as to be gradually reduced in height from the high ribs toward fringe part on the top surface part.

2. The cleaning tool according to claim 1, wherein a center of gravity is positioned in a part close to the head part when the handle part is divided into two in a longitudinal direction in a state where the handle part is horizontally laid down both in a state where the bottom surface part is attached to the top surface part and a state where the bottom surface part is not attached to the top surface part.

3. The cleaning tool according to claim 2, wherein the bottom surface part is formed to have a mass of 30 g to 600 g.

4. The cleaning tool according to claim 2, wherein the handle part is capable of adjusting the length, and a center of gravity position is capable of being changed by changing the length of the handle part.

5. The cleaning tool according to claim 2, wherein the handle part is capable of adjusting a weight, and the center of gravity position is capable of being changed by changing the weight of the handle part.

6. The cleaning tool according to claim 1, wherein the bottom surface part is formed to have a mass of 30 g to 600 g.

7. The cleaning tool according to claim 6, wherein the handle part is capable of adjusting the length, and a center of gravity position is capable of being changed by changing the length of the handle part.

8. The cleaning tool according to claim 6, wherein the handle part is capable of adjusting a weight, and the center of gravity position is capable of being changed by changing the weight of the handle part.

9. The cleaning tool according to claim 1, wherein the handle part is capable of adjusting the length, and a center of gravity position is capable of being changed by changing the length of the handle part.

10. The cleaning tool according to claim 9, wherein the handle part is capable of adjusting a weight, and the center of gravity position is capable of being changed by changing the weight of the handle part.

11. The cleaning tool according to claim 1, wherein the handle part is capable of adjusting a weight, and the center of gravity position is capable of being changed by changing the weight of the handle part.

12. The cleaning tool according to claim 1, wherein a thickness of the head part is 15 mm to 25 mm in the highest portion and 12 mm or less in the central part of the top surface part to which the handle part is attached through a joint part.

13. The cleaning tool according to claim 1, wherein the high ribs are formed so as to protrude downward by 1 mm to 3 mm from a lower end portion of the fringe part of the top surface part, and the high ribs are formed in a range of 50% to 80% with respect to a whole length in the Y-axis direction of the top surface part, and the high ribs are formed in a range of 30% to 60% with respect to a whole length in the X-axis direction of the top surface part.

14. The cleaning tool according to claim 1, wherein a joint part comparises a first yoke part, a second yoke part and a connecting part, the first yoke part provided in the approximately central part on the upper surface side of the top surface part in the head part, the second yoke part provided at a lower end part of the handle part, a connecting part connecting the first yoke part and the second yoke part, a first connection between the first yoke part and the connecting part enables a rotating movement in the X-axis direction, and a second connection between the connecting part and the second yoke part enables a rotating movement in the Y-axis direction.

* * * * *